United States Patent [19]

Yoshida et al.

[11] 4,109,450

[45] Aug. 29, 1978

[54] OPEN-END SPINNING MACHINE AND A METHOD OF RESTARTING THE SAME

[75] Inventors: Yoshiaki Yoshida; Osamu Suzuki, both of Obu; Keizi Onoue, Kariya, all of Japan

[73] Assignee: Kabushiki Kaisha Toyoda Jidoshokki Seisakusho, Aichi, Japan

[21] Appl. No.: 788,283

[22] Filed: Apr. 18, 1977

[51] Int. Cl.[2] ..... D01H 15/00; D01H 1/12

[52] U.S. Cl. ..... 57/34 R; 57/58.95; 57/156; 242/18 DD; 242/35.5 R

[58] Field of Search ..... 57/34 R, 58.89–58.95, 57/78–81, 156; 242/18 R, 18 DD, 35.5 R, 35.6 R

[56] References Cited

U.S. PATENT DOCUMENTS

| | | | |
|---|---|---|---|
| 3,354,626 | 11/1967 | Cizek et al. | 57/78 |
| 3,640,477 | 2/1972 | Furst | 242/18 R |
| 3,678,673 | 7/1972 | Prochazka et al. | 57/58.95 |
| 3,939,638 | 2/1976 | Bruckert et al. | 57/34 R X |
| 4,002,306 | 1/1977 | Raasch | 242/18 DD X |
| 4,033,107 | 7/1977 | Sasayama et al. | 57/34 R X |
| 4,060,207 | 11/1977 | Miyazaki et al. | 242/18 R |

*Primary Examiner*—John Petrakes

*Attorney, Agent, or Firm*—Burgess, Ryan and Wayne

[57] ABSTRACT

Disclosed is an open-end spinning machine and a method of restarting the same. The machine comprises: feed rollers, for supplying fibers to a combing roller so as to comb the fibers; a spinning rotor, for collecting the combed fibers into a yarn and for twisting the yarn, connected to a power source via an endless driving belt; a pair of draw off rollers, for withdrawing the yarn from the spinning rotor, connected to a brake and to a main power source via a clutch; a traverse guide, for traversing the withdrawn yarn along a bobbin supported by a pair of cradle arms, connected to a brake and to the main power source via a clutch; a winding drum, for frictionally driving the bobbin to wind the yarn around the bobbin and form a conical cheese, connected to a brake and to the draw off rollers via gear trains, and; a controlling device, for controlling the brakes and clutches according to a predetermined program, by which, on the occasion of stopping said machine, the traverse guide is stopped at a predetermined position before both the draw off rollers and the winding drum are stopped and, on the occasion of restarting said machine, the traverse of the traverse guide is started toward the smaller diameter portion of the conical cheese, when a pieced joint formed between an end of the yarn and a newly spun yarn reaches a contacting line formed between the pair of draw off rollers. By utilizing this machine and method, the number of yarn breakages occurring during the starting operation is decreased.

13 Claims, 4 Drawing Figures

OPEN-END SPINNING MACHINE AND A METHOD OF RESTARTING THE SAME

SUMMARY OF THE INVENTION

The present invention relates to an improved open-end spinning machine utilizing a quick yarn traverse winding system, called a QT system, and to a method of restarting the same.

In practical mill operations the open-end spinning machines are usually stopped during non-operating hours of the mill. In addition, in some cases, an open-end spinning machine is stopped when a yarn breakage is detected so as to repair the broken yarn. In such cases, it is required that the open-end spinning machine be easily restarted.

To facilitate easy restarting of an open-end spinning machine, many stopping and restarting methods of the same have been proposed. For example, a normal and reverse rotating method will now be explained as a usual method for stopping a conventional open-end spinning machine. The supply of fibers to the spinning rotor, which collects the fibers into a yarn is stopped first. Then, after a predetermined time has passed, the rotation of the draw off rollers, which withdraw the yarn from the spinning rotor, and the winding drum which frictionally rotates the bobbin, and the traverse motion of the traverse guide, which traverses the yarn along the bobbin, are stopped. When the machine is started again, the draw off rollers and the winding drum are first rotated in the direction opposite to the normal rotating direction thereof. This allows the yarn wound around the bobbin to be unwound and the end of the yarn situated in a delivery tube connected to the spinning rotor to be sent back into the spinning rotor. At the same time fibers are supplied into the spinning rotor by a combing roller so as to facilitate the piecing up of the yarn. After a predetermined time has passed, the draw off rollers and the winding drum are rotated in the normal direction, and the traverse of the traverse guide is simultaneously started, so that the winding of the yarn is commenced.

However, in the above described method, because the piecing joint of the yarn is exposed to an excessive yarn tension, yarn breakage may occur frequently between the winding drum and the yarn traverse guide when the machine is started.

Especially, in an open-end spinning machine utilized for forming a conical cheese, the above-mentioned defect may occur more frequently. The reason for this is as follows. When the yarn is wound around a bobbin forming a conical cheese in an open-end spinning machine, the yarn is fed from supply means at a constant speed. The conical cheese has both a bottom portion which has a maximum diameter, and a top portion which has a minumum diameter. Therefore, a yarn path length variation is caused by the yarn length difference in the circumferential length of the conical cheese during the winding operation. As a result, the yarn is exposed to different tensions as the winding position moves toward a smaller diameter portion from the bottom portion of the conical cheese during the winding operation. it should be noted that, with a conventional open-end spinning machine, the traverse guide is not at one particular position when the traverse guide is restarted. This means that the traverse guide may be located at any position between a smaller diameter portion and a larger diameter portion of the conical cheese.

When a pair of draw off rollers, a winding drum and a traverse guide are rotated in their normal rotating directions after an end of the yarn and a newly spun yarn are pieced up, the traverse guide may move toward the larger diametet portion of the cheese in some cases and may move toward the smaller diameter portion of the cheese in other cases. In the former cases, the yarn between the draw off rollers and the winding drum is exposed to an excessively increased tension. Breakage of the yarn can occur while the piecing joint and its adjacent portion, which have low strength, run between the draw off rollers and the winding drum. Such a breakage is considered a failure of automatic piecing up of the open-end spinning machine. In the latter case, the yarn tension between the draw off rollers and the winding drum will not increase and no yarn breakage will occur.

An object of the present invention is to provide an open-end spinning machine and a method of restarting the same, by which the above-mentioned defect can be eliminated.

Another object of the present invention is to provide an open-end spinning machine and a method of restarting the same, by which the increase of tension on the yarn between the yarn traverse guide and the winding drum can be maintained within a predetermined range while the traverse guide, the draw off rollers and the winding drum are moved in their normal rotating direction.

A further object of the present invention is to provide an open-end spinning machine and a method of restarting the same by which the traverse guide is moved toward a smaller diameter portion of the conical cheese when the pieced joint reaches a contacting line formed between the pair of draw off rollers.

The above-mentioned and further objects, as well as novel features, of the present invention will be more fully apparent from the detailed description of the same, set forth below, with reference to the accompanying drawings. It is to be understood, however, that the drawings are for purposes of illustration only and are not intended as a definition of the limits of the invention.

DETAILED DESCRIPTION OF THE INVENTION

Figure 1:
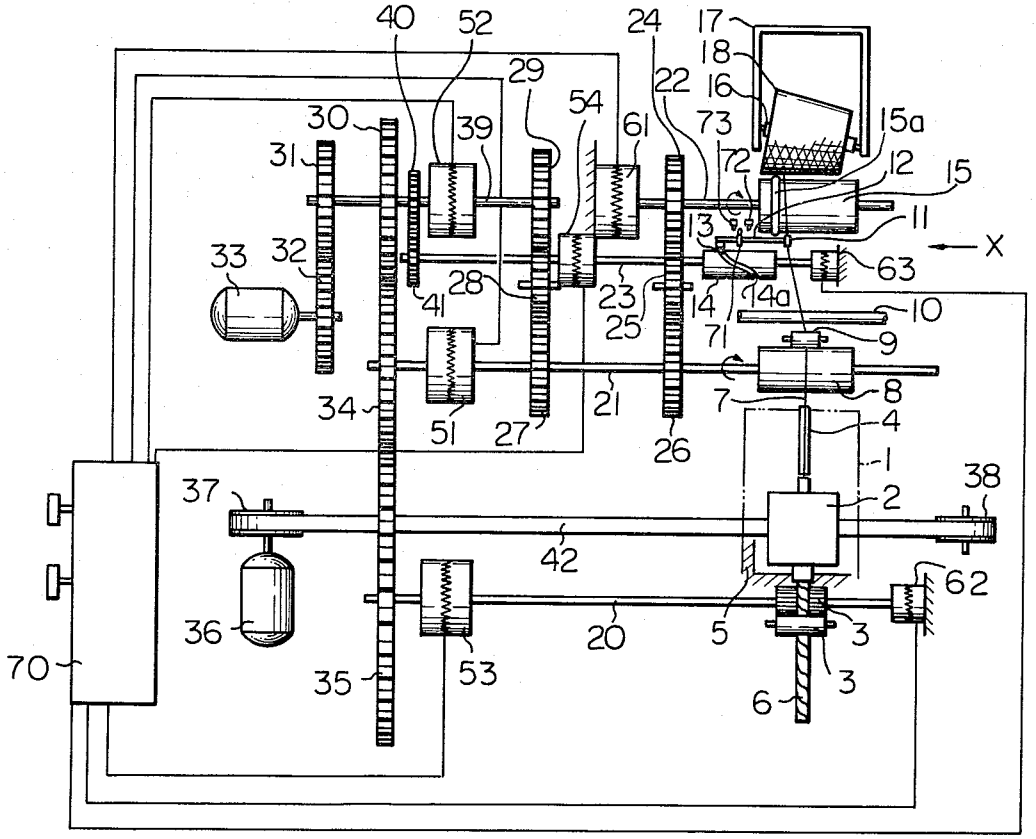
FIG. 1 is a schematic elevational view of an open-end spinning machine for carrying out the method of the present invention.

An open-end spinning machine, according to the present invention is explained hereinafter with reference to the accompanying drawings. Although the open-end spinning machine is usually provided with a plurality of spinning units, an open-end spinning machine which is provided with only one spinning unit, is shown in FIG. 1. Referring to FIG. 1, a spinning unit 1 comprises a spinning rotor 2 rotatably mounted on a frame 5, feed rollers 3 and a delivery tube 4. The feed rollers 3 are utilized for applying fibers 6 to a combing roller (not shown). The combing roller is rotatably mounted within the spinning unit 1 so as to be rotated with the spinning unit 1, and is utilized for combing the supplied fibers 6 and for supplying said combed fibers 6 to the spinning rotor 2. The spinning rotor 2 collects the supplied fibers 6 into a yarn 7 and twists the yarn 7. A draw off roller 8, having a press roller 9 swingably mounted thereon, for withdrawing the yarn 6 from the spinning rotor 2 via the delivery tube 4, is provided at a position downstream of said delivery tube 4. A guide bar 10, for guiding the yarn 7, is disposed at a position between the draw off roller 8 and a traverse guide 11 disposed on a traverse rod 12. An end of the traverse rod 12 is provided with a pin 13 which slidably penetrates into a groove 14*a* formed on a surface of a groove roller 14. Consequently the traverse guide 11 is traversed to and fro when the groove roller 14 is rotated. The traverse rod 12 is also provided with a dog 71. The dog 71 hits both a first limit switch 72, having a contact *ls* 1, disposed at a position where the dog 71 is situated at the end of the traverse motion, and a second limit switch 73, having a contact *ls* 2, disposed at a intermediate portion of the traverse motion. A winding drum 15, provided with a driving member 15*a* having a larger diameter than the remaining portion of the winding drum 15, is disposed at a position downstream of the traverse guide 11 and is utilized for frictionally rotating a bobbin 16, rotatably mounted on a pair of cradle arms 17. The bobbin 16 is disposed so as to be inclined to the rotational axis of the winding drum 15, so that the yarn 6 is wound around the bobbin 16 and forms a conical cheese 18.

Figure 2:
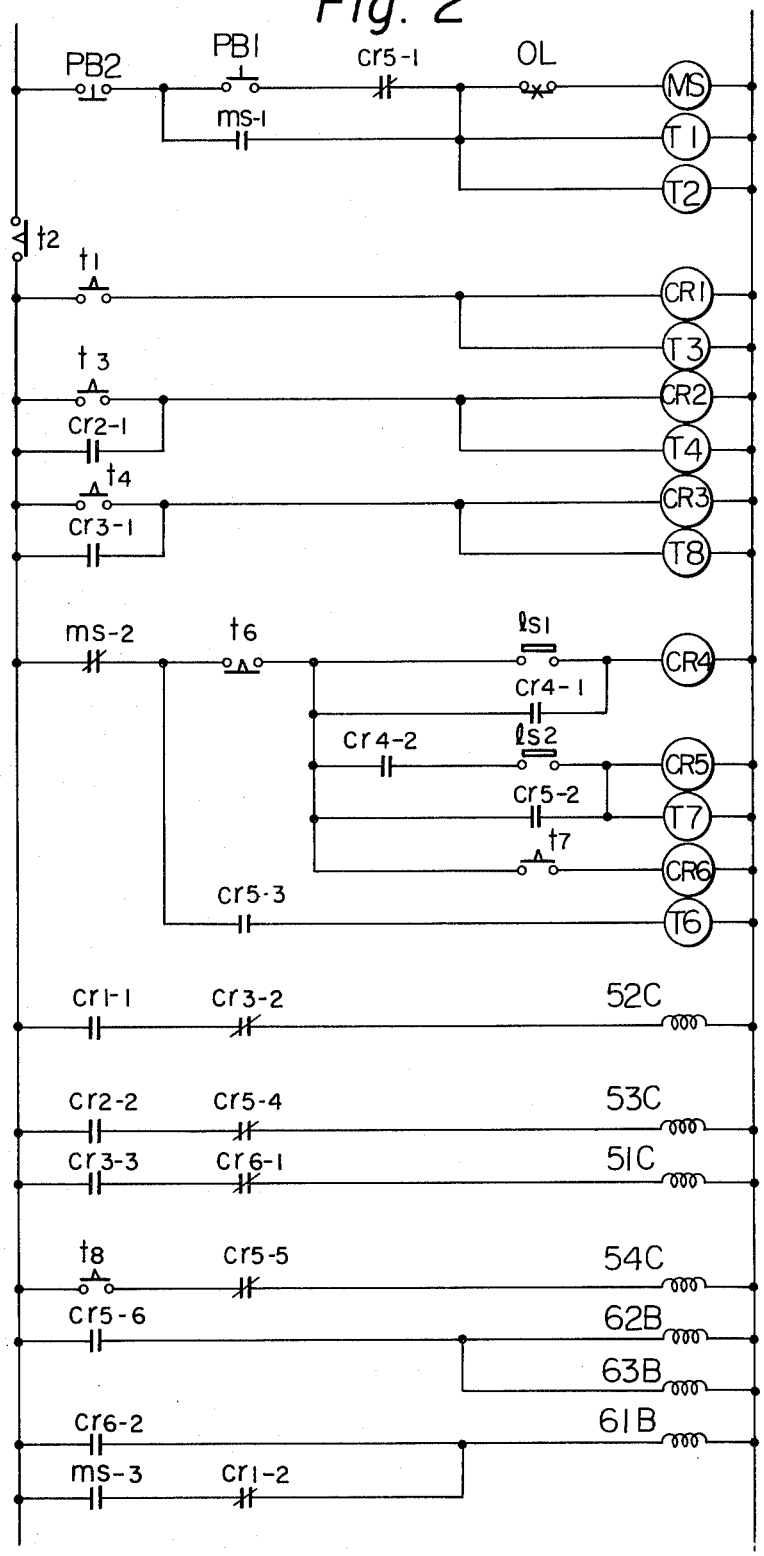
FIG. 2 is a wiring diagram utilized in the machine shown in FIG. 1.

Both a shaft 21 of the draw off roller 8 and a shaft 22 of the winding drum 15 are rotated in the same direction by way of the gear trains 24, 25 and 26. Each of the shafts 21 and 22 is rotatably supported by a bearing (not shown) which is fixed to the frame 5. The two shafts 21 and 22 are driven by an electric motor 33. Each shaft 21, 22 is driven in a normal rotating direction by the motor 33 by way of an electromagnetic clutch 51, which is mounted on the shaft 21. Each shaft 21, 22 is driven by the motor 33 in the reverse rotating direction by way of an electromagnetic clutch 52, which is mounted on a shaft 39. Gear trains 27, 28, 29, 30, 31, 32 and 34 are provided as driving gear trains, but the former gear trains 27, 28 and 29 are used only in case it is required to drive the shaft 21 in the reverse rotating direction. A shaft 20 of the feed roller 3 is driven by the gear 34 by way of a gear 35 and an electromagnetic clutch 53. The shaft 20 of the feed roller 3 and the shaft 22 of the winding drum 15 are provided with a magnetic brake 62 and a magnetic brake 61, respectively. The magnetic brakes 61 and 62 and electromagnetic clutches 51, 52 and 53 are controlled by an electric control circuit 70. An electric motor 36 drives the spinning rotor 2 by means of an endless belt 42 which is slidably bridged between a wheel 37, connected to the electric motor 36, and a wheel 38. It should be noted that the endless belt 42 also drives other spinning rotors which belong to respective open-end spinning units, however, other open-end spinning units are not shown in FIG. 1. A shaft 23 of the grooved roller 14, which extends behind gears 24, 25, 26, 27, 28 and 29, is driven by the motor 33 by way of gear trains 31, 32 40 and 41 and an electromagnetic clutch 54 mounted on the shaft 23. The shaft 23 of the grooved roller 14 is provided with a magnetic brake 63. The electromagnetic clutch 54 and the magnetic brake 63 are controlled by the electric control circuit 70. The electromagnetic clutches 51, 52, 53 and 54 and the magnetic brakes 61, 62 and 63 include exciting coils 51C, 52C, 53C, 54C, 61B, 62B and 63B (FIG. 2), respectively, for the driving thereof and these exciting coils are wired as shown in FIG. 2.

The electric circuit 70 for controlling the open-end spinning machine is hereinafter explained with reference to the accompanying FIG. 2. In FIG. 2, PB1 designates a push-button switch for starting the operation of the open-end spinning machine of the present invention. PB2 designates a push-button switch for stopping the operation of the open-end spinning machine. MS and *ms*-1 through *ms*-3 designate a solenoid coil of a relay and the contacts of the relay, respectively, for starting the main motor 33 (FIG. 19 mechanically connected to feed rollers 3, draw off roller 8, groove roller 14 and winding drum 15 via suitable power transmitting means such as a gear train as shown in FIG. 1 and for starting the motor 36 connected to the spinning rotor 2. T1 through T8 and *t*1 through *t*8 designate time switches and the contacts thereof, respectively. CR1 through CR6 and *cr*1-1 through *cr*6-2 designate solenoid coils of relays and the contacts of the relays, respectively. OL designates a relay switch which operates when an overload current flows.

The operation of the open-end spinning machine according to the present invention is hereinafter explained with reference to FIGS. 2 and 3.

A. Stopping Operation of the Open-End Spinning Machine (1) During normal operation, the solenoid coils of the relays MS, CR1, CR2 and CR3, the time switches T1, T2, T3, T4 and T8, and the exciting coils 51C and 53C are energized. Therefore, the feed roller 3 supplies the fibers 6 into the spinning rotor 2. The fibers 6 are combed within the spinning rotor 2 by the combing roller (not shown), and collected into a yarn 7, and the yarn 7 is twisted within the spinning rotor 2. Then, the yarn 7 is traversed to and fro by the traverse guide 11 and wound around a bobbin 16 forming a conical cheese 18.

(2) When the push-button switch PB2 is pushed, the operation of the solenoid coil of the relay MS for operating the main motor 33 and the motor 36 (FIG. 1) is stopped. Then the main motor 33 is turned off. However, the main motor is connected to the feed-roller 3, draw off roller 8 and the winding drum 15, and has a large inertia and consequently, the main motor 33 continues its rotation for a while. In addition, when the relay MS is stopped, the motor 36 is turned off and is brought to a standstill after a certain delay time $T_a$. The delay time $T_a$ is generated by the inertia of the spinning rotors 2. The fiber supply, however, is stopped when the feed roller 3 is stopped, before the spinning rotor 2 is stopped. At the same time, the time switch T2 is energized.

(3) Since the solenoid coil of the relay MS is open, the circuit comprising the break contact *ms*-2, the break contact *t*6 of the time switch T6, having a predetermined time $T_6$, the contact *ls* 1 of the first limit switch 72, and the solenoid coil of the relay CR4, is closed when the dog 71 hits the first limit switch 72. Then the relay CR4 is energized via the contact *cr*4-1.

(4) The circuit comprising the break contact *ms*-2, the break contact *t*6 of the time switch T6, the contact *cr*4-2 of the relay CR4, the contact *ls* 2 of the second limit switch 30, and the solenoid coil of the relay CR5, is closed when the dog 72 hits the second limit switch 73. Then the relay CR5 is energized via the contact *cr*5-2 and the time switch T7 is also energized. In addition, the circuit comprising the break contact *ms*-2, the contact *cr*5-3 of the relay CR5, and the time switch T6, is closed. This means that the relay CR5 and the time switches T6 and T7 are energized only when the dog 28 hits the first limit switch 72 and then the other limit switch 73 in sequence. This occurs when the traverse guide 11, disposed on the traverse rod 12, as well as the dog 71 move in the direction of the arrow X shown in FIG. 1 (move toward the larger diameter portion of the cheese 10) and reach a predetermined certain position.

(5) When the solenoid coil of the relay CR5 is energized, both the circuit comprising the contact *cr*2-2 of the relay CR2, the contact *cr*5-4 of the relay CR5 and the exciting coil 53 for driving the clutch 53, and the circuit comprising the contact *t*8 of the time switch T8, the break contact *cr*5-5 of the relay CR5 and the exciting coil 54C for driving the clutch 54, are opened. Then, the driving of the electromagnetic clutch 53 connected to the feed roller 3 and the electromagnetic clutch 54 connected to the groove roller 14, with which the traverse guide 11 is engaged, is stopped. At the same time, the circuits comprising the contact *cr*5-6 and both the exciting coil 62B, for driving the brake 62 connected to the feed roller 3, and the exciting coil 63B, for driving the brake 63 connected to the groove roller 14 with which the traverse guide 11 is engaged, are closed. Then the feed roller 3 and the traverse guide 11 are braked and brought to a standstill.

(6) When the predetermined time $T_7$ has passed after the time switch T7 is energized, the time switch T7 is closed and the circuit comprising the break contact *ms*-2 of the relay MS, the break contact *t*6 of the time switch T6, the contact *t*7 of the time switch T7 and the solenoid coil of the relay CR6, is closed.

(7) When the solenoid coil of the relay CR6 is energized, the circuit comprising contact *cr*3-3 of the relay CR3, the break contact *cr*6-1 of the relay CR6 and the exciting coil 51C for driving the electromagnetic clutch 51 is opened. Therefore, the electromagnetic clutch 51 connected to the winding drum 15 and the draw off roller 8, becomes open. At the same time, the circuit comprising contact *cr*6-2 and the exciting coil 61B for driving the magnetic brakes 61 is closed. Then, the magnetic brake 61 connected to the winding drum 15 and draw off roller 8, becomes engaged and both the winding drum 15 and the draw off roller 8 are brought to a standstill, while the main motor 33 continues its rotation due to its inertia.

(8) Since the time switch T6 is adjusted to have a longer time delay than that of time switch T7, when the time switch T6 is energized for the predetermined time $T_6$, the time switch T6 is closed after the time switch T7. Then, the solenoid coils of the relays CR4, CR5 and CR6, wired to the break contact *t*6, become open. Then the exciting coils 61B, 62B and 63B driving the magnetic brakes 61, 62 and 63, respectively, become open.

(9) When the predetermined time $T_2$ is passed after the push-button switch PB2 is pushed, the time switch T2 is closed. Then the break contact *t*2 of the time switch T2 is opened and, at that time, all of the holding circuits are open.

The stopping operation of the open-end spinning machine according to the present invention is completed as described above. During the stopping operation of the machine, the traverse guide 11 moving in a predetermined direction is stopped at a predetermined position.

B. Starting Operation of the Open-End Spinning Machine (1) when the push-button switch PB1 is pushed, the solenoid coil of the relay MS is excited and the circuits (not shown) of the main motor 33 and motor 36 (FIG. 1) are closed, whereby the main motor 33 and the motor 36 are started. As a result, the spinning rotor 2 and the combing roller (not shown), connected to the motor 36, are rotated up to a normal high speed after a start-up time $T_a$. Since the normal speed of the spinning rotor 2 is significantly higher than that of the other means, the start-up delay time $T_b$ is generated by the inertia of the spinning rotors 2, while the spinning rotors 2 are sped up. Since the main motor 33 is disconnected from the feed roller 3, the draw-off roller 8 and the winding drum 15 at the starting-up thereof, the main motor 33 reached its normal rotating speed in a very short time after the push-button switch PB1 is pushed. At the same time, the circuits comprising the push-button switch PB2, for stopping the open-end spinning machine, the contact *ms*-1 of the relay MS and the time switch T1, and the circuit comprising the push-button switch PB2, the contact *ms*-1 of the relay MS and the time switches T1 and T2, are closed. Then, the break contact *t*2 of the time switch T2 having a predetermined time delay $T_2$ is closed immediately. For a predetermined delay time $T_1$ which is adjusted to be slightly longer than the start-up time $T_b$ the time switch T1 is energized and is closed.

(2) When the contact *t*1 of the time switch T1 is closed, the solenoid coil of the relay CR1 and time switch T3 are energized. Since the contact *cr*1-1 of the relay CR1 is closed, the circuit comprising the contact *cr*1-1, the break contact *cr*3-2 of the relay CR3 and the solenoid coil 52C, of the electromagnetic clutches 52 is closed. Because the electromagnetic clutch 52 is connected to the winding drum 15 and the draw off roller 8 via gear trains 24, 25 and 26 for reversely rotating the winding drum 15 and the draw off roller 8, when the above-mentioned circuits including the solenoid coil 52C is closed, the winding drum 15 and the draw off roller 8 are rotated in a direction opposite to their normal rotating direction. As mentioned in item (1) above, when the push-button switch PB1 is pushed, the spinning rotor 2 is rotated. This causes the air pressure within the spinning rotor 2 to be decreased and the yarn 7 becomes slack due to the above-mentioned reverse rotation of the draw off roller 8. Therefore, an end of the yarn (not shown) situated in the delivery tube 4 is caused to move back into the spinning rotor 2 by the above-mentioned decreased air pressure.

(3) After the time switch T3 is energized for a predetermined delay time $T_3$, the make contact *t*3 of the time switch T3 is closed, and the solenoid coil of the relay CR2 and the time switch T4 are energized. When the solenoid coil of the relay CR2 is energized, the circuit comprising the contact *cr*2-2 of the relay CR2, the break contact *cr*5-4 of the relay CR5 and the exciting coil 53, for driving the clutch 53 connected to the feed roller 3, is closed. Then the feed roller 3 starts to rotate and fibers 6 begin to be supplied into the spinning rotor 2. As a result, the end of yarn and the supplied fibers are pieced up within the spinning rotor 2.

(4) When a predetermined delay time $T_4$ has passed after the close of the make contact *t*3 of the time switch T3 and after the time switch T4 is energized, the time switch T4 is closed and both the solenoid coil of the relay CR3 and time switch T8 are energized. When the solenoid coil of the relay CR3 is energized, the break contact *cr*3-2 opens and the exciting coil 52C becomes open. In addition, the circuit comprising the contact *cr*3-3 of the relay CR3, the break contact *cr*6-1 of the relay CR6 and the exciting coil 51C for driving the electromagnetic clutches 51 is closed. Then the winding drum 15 and the draw off roller 8 are rotated in their normal rotating direction.

The predetermined delay times $T_3$ and $T_4$ of the time switches T3 and T4 are suitably determined so that the above-mentioned piecing up operation can be carried out and the newly supplied fibers 6 collected in the spinning rotor 2 can be withdrawn from the spinning rotor 2 to the draw off roller 8 and press roller 9.

(5) For a predetermined time $T_8$, the time switch T8 is energized and, then, the switch T8 is closed. Thereafter, the circuit comprising the contact *t*8 of the time switch T8, the break contact *cr*5-5 of the relay CR5 and the exciting coil 54C for driving the clutch 54 is closed. As a result, the groove roller 14, provided with the clutch 54, starts to rotate in its normal rotating direction. Consequently, the traverse guide 11 is traversed to and fro via the groove roller 14.

The traverse of the traverse guide 11 is adjusted so as to direct the traverse guide 11 toward the smaller diameter portion of the conical cheese when the pieced joint formed between the end of the yarn and the newly spun yarn reaches the contacting line formed between the draw off roller 8 and a press roller 9. This adjustment is made by adjusting the delay time $T_8$ of the time switch T8. This adjusting operation is facilitated by stopping the yarn guide at a predetermined position as mentioned above. According to the present invention, the traverse guide 11 may be adjusted so that the traverse guide 11 will stop at a predetermined position situated in front of the larger diameter portion of the conical cheese 18.

Figure 4:
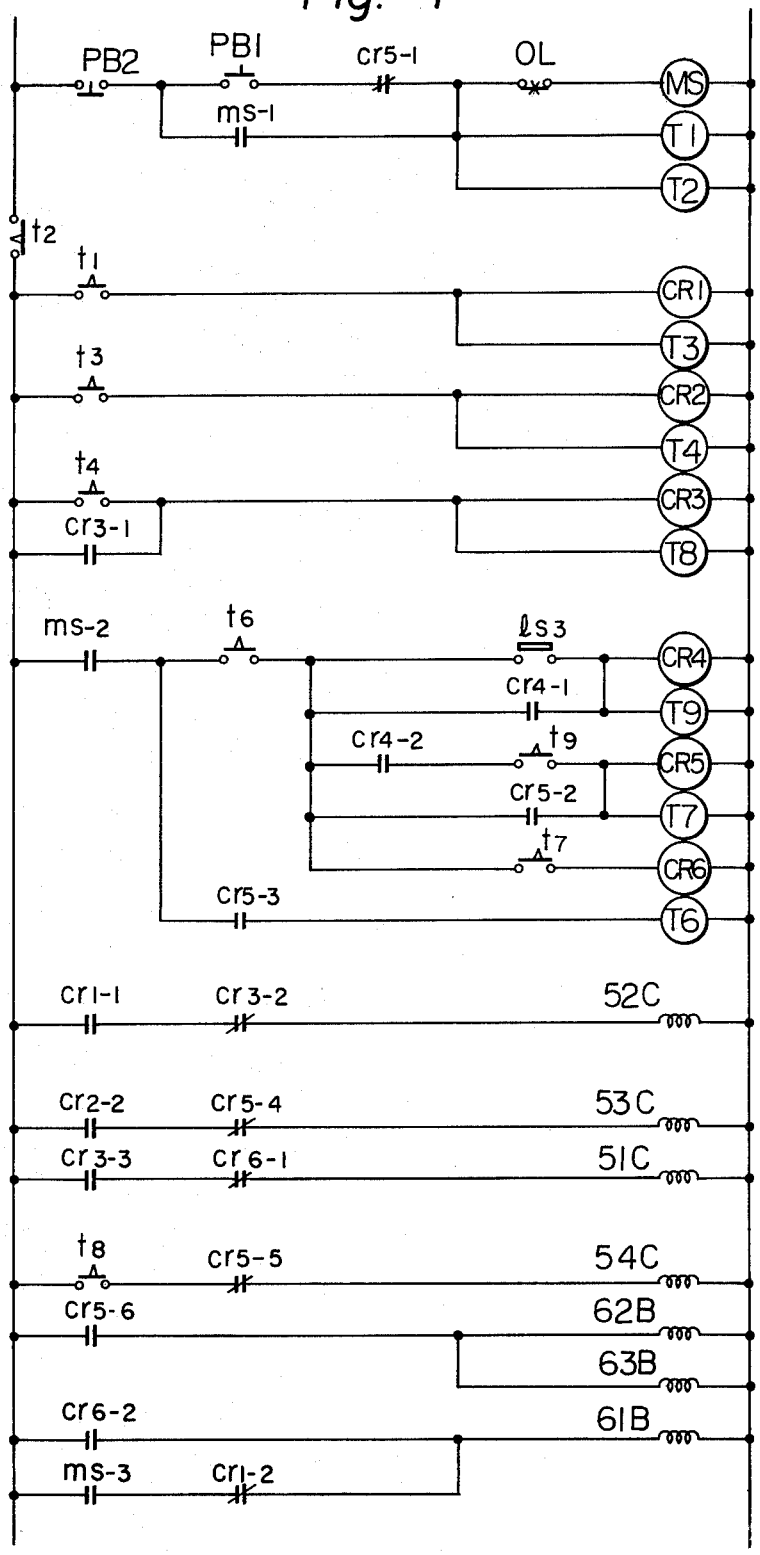
FIG. 4 is another operational wiring diagram of a machine similar to the machine shown in FIG. 1.

Non touching type sensing devices such as a photoelectric tube or a photo-electric cell may be utilized instead of the above described limit switches 72 and 73. In addition, limit switches 72 and 73 may be changed to a limit switch and a time switch, respectively. In this case the limit switch 72 can be a commercially available limit switch. However, it is necessary that the limit switch 72 be closed only when it is hit by the dog 71 moving in the direction of the arrow X shown in FIG. 1, so that limit switch can detect that the traverse guide 11 is moving in the direction of the arrow X. The controlling circuit is shown in FIG. 4. As is apparent in FIG. 4, the circuit is very similar to that shown in FIG. 2 and, therefore, the same parts are designated with the same referencial numerals in FIGS. 2 and 4. In FIG. 4, *ls*3 designates a contact of the limit switch 72, and T9 and *t*g designate a time switch and contact of the time switch.

In the circuit shown in FIG. 2, the traverse guide 11 is stopped after the dog 71 hits the limit switches 72 and 73, having contacts *l s*1 and *l s*2, in sequence. In the circuit shown in FIG. 4, the traverse guide 11 is stopped after the dog 71, which is moving in a direction of the arrow X, hits the limit switch 72 and the time switch T9 calculates the time for the stopping of the traverse guide.

When the yarn denier is changed, the withdrawing speed of the draw off roller 8 and the press roller 9 and the winding drum 14 is changed. As a result, the time interval during which the pieced joint moves from the spinning rotor 2 to the contacting line formed by the draw off roller 8 and the press roller 9 varies. Therefore, the above described predetermined position, where the traverse guide is stopped, must also be varied. This is accomplished by adjusting the setting position of the limit switch 73 or adjusting the delay time $T_6$ of the time switch T6 in the first embodiment shown in FIG. 3, or adjusting the delay times $T_6$, $T_7$ of the time switches T6, T7.

The method according to the present invention can also be applied to an open-end spinning machine in which a yarn situated between the spinning rotor or the delivery tube and the draw off roller is moved in a direction perpendicular to the normal yarn path by way of a yarn path bending guide means at the time a signal for a machine stop is actuated, and the yarn is reserved along a bent yarn path. When the machine is started, the guide means is moved back and the yarn becomes free from the guide means. Consequently, the end of the yarn is moved back into the spinning rotor and is pieced up.

What is claimed is:

1. A method of restarting an open-end spinning machine comprising: feed rollers for supplying fibers to a combing roller so as to comb the fibers, a spinning rotor for collecting said combed fibers into a yarn and for twisting said yarn, a pair of draw off roller means forming a contacting line therebetween for withdrawing said yarn from said spinning rotor, a delivery tube disposed at a position between said spinning rotor and said draw off roller means, a traverse guide for traversing said withdrawn yarn along a bobbin supported by cradle means, and a winding drum for frictionally driving said bobbin to wind said yarn around said bobbin and form a conical cheese, said method comprising: on the occasion of stopping said machine, a first step of stopping said traverse motion of said traverse guide to bring said traverse quide to a predetermined position; on the occasion of starting said machine, a second step of rotation both said draw off roller means and said winding drum in a direction opposite to their normal rotating directions; a third step of rotating said feed rollers according to a predetermined program so that the said feed rollers begin to rotate after an end of the yarn is moved back into said spinning rotor where said moved back yarn is pieced up with the newly spun yarn; a fourth step of rotating both said draw off roller means and said winding drum in their normal rotating directions, and starting the traverse motion of said traverse guide so as to move said traverse guide toward a smaller diameter portion of said conical cheese along the axis of said conical cheese when the pieced joint formed between said end of the yarn and said newly spun yarn reaches said contacting line formed between said draw off roller means.

2. A method of restarting an open-end spinning machine according to claim 1, wherein said predetermined position is in front of the larger diameter portion of said conical cheese.

3. A method of restarting an open-end spinning machine according to claim 1, wherein said traverse guide begins its traverse motion after both said draw off roller means and said winding drum begin their normal rotation.

4. An open-end spinning machine comprising:

feed rollers, for supplying fibers to a combing roller so as to comb the fibers;

a spinning rotor for collecting said combed fibers into a yarn and for twisting said yarn;

a pair of draw off roller means forming a contacting line, for withdrawing said yarn from said spinning rotor, having a first means for engaging with and disengaging from a main power source;

a traverse guide for traversing said withdrawn yarn along a bobbin supported by cradle means, said traverse guide being connected to a second means for engaging with and disengaging from said main power source;

a winding drum, for frictionally driving said bobbin to wind said yarn around said bobbin and form a conical cheese, connected to said draw off rollers means by way of transmitting means, and;

controlling means, for controlling the above-mentioned two means according to a predetermined program, by which, on the occasion of stopping said machine, said traverse guide is stopped at a predetermined position and, on the occasion of restarting said machine, said traverse guide is restarted so as to move toward a smaller diameter portion of said conical cheese when a pieced joint formed between an end of said yarn and a newly spun yarn reaches said contacting line formed between said draw off roller means.

5. An open-end spinning machine according to claim 4, wherein said controlling means operates so as to stop said traverse guide before both draw off roller means and said winding drum are stopped.

6. An open-end spinning machine according to claim 4, wherein said traverse guide, said draw off roller means and said winding drum have braking means so that the stopping operation of the machine is facilitated.

7. An open-end spinning machine according to claim 4, wherein said controlling means includes a first device for detecting a moving direction of said traverse guide, and a second device for calculating the time of stopping said traverse guide.

8. An open-end spinning machine according to claim 7, wherein said first and second devices comprise limit switches.

9. An open-end spinning machine according to claim 8, wherein said control means includes a relay (CR4) which is energized when said first device is actuated, by the traverse motion of said traverse guide, and a relay (CR5), which is energized when said second device is actuated while said relay (CR4) is energized, for stopping said traverse motion of said traverse guide.

10. An open-end spinning machine according to claim 9, wherein said control means further includes a time switch (T7), having a delay time ($T_7$) for calculating the time between energizing of said relay (CR5) and stopping of said traverse guide.

11. An open-end spinning machine according to claim 7, wherein said first device comprises a limit switch and said second device comprises a time switch.

12. An open-end spinning machine according to claim 9, wherein said control means includes a relay (CR4) which is energized when said first device is actuated by the traverse motion in a particular direction of said traverse guide, and a relay (CR5), which is energized when said time switch (T9), having a delay time ($T_9$), is energized for said time ($T_9$), for stopping said traverse motion of said traverse guide.

13. An open-end spinning machine according to claim 12, wherein said control means further includes a time switch (T7), having a delay time ($T_7$) for calculating the time between energizing of said relay (CR5) and stopping of said traverse guide.

* * * * *

UNITED STATES PATENT OFFICE

CERTIFICATE OF CORRECTION

Patent No. 4,109,450 Dated August 29, 1978

Inventor(s) Yoshiaki Yoshida et al.

Figure 3:
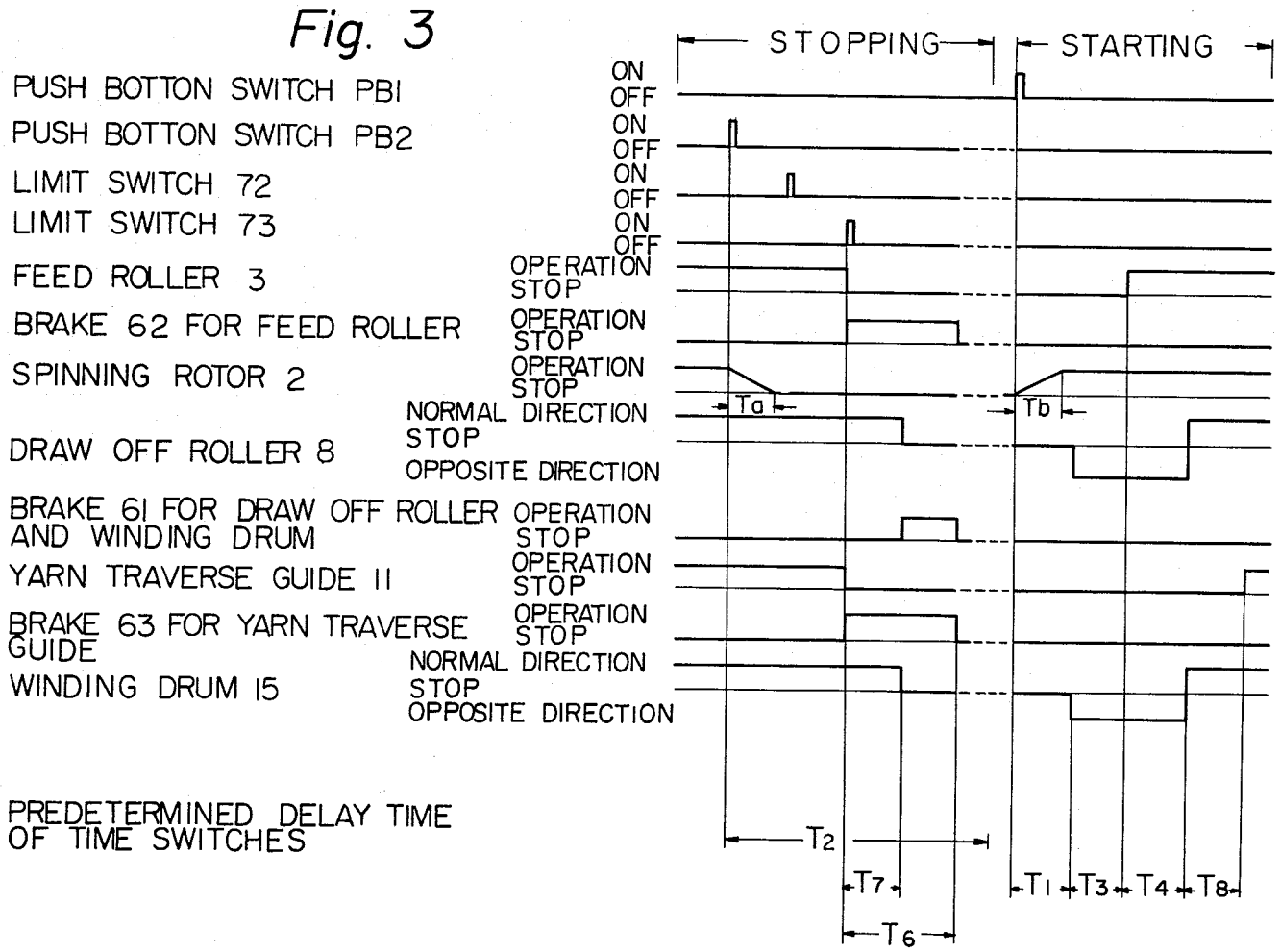
FIG. 3 is an operational diagram of the machine shown in FIG. 1.

It is certified that error appears in the above-identified patent and that said Letters Patent are hereby corrected as shown below:

Figure 3 - Left column, lines 1 and 2 thereof: "BOTTON" should read --BUTTON--.

Column 2, line 5: change "diametet" to --diameter--.

Column 7, line 51: change "referencial" to --reference--.

Column 8, line 37: change "quide" to --guide--.

Signed and Sealed this

*Twenty-second* Day of *May 1979*

[SEAL]

*Attest:*

RUTH C. MASON
*Attesting Officer*

DONALD W. BANNER
*Commissioner of Patents and Trademarks*